United States Patent [19]

Stevenson

[11] 4,358,325

[45] Nov. 9, 1982

[54] METHOD OF TREATING LOW CARBON STEEL FOR IMPROVED FORMABILITY

[75] Inventor: Robin Stevenson, Royal Oak, Mich.

[73] Assignee: General Motors Corporation, Detroit, Mich.

[21] Appl. No.: 244,931

[22] Filed: Mar. 18, 1981

Related U.S. Application Data

[63] Continuation of Ser. No. 71,651, Aug. 31, 1979, abandoned.

[51] Int. Cl.[3] ..... C21D 9/48

[52] U.S. Cl. ..... 148/125; 148/12 C

[58] Field of Search ..... 148/12 C, 12 F, 125, 148/12.1, 16.7, 12.4, 12.3, 12 R

[56] References Cited

U.S. PATENT DOCUMENTS

| | | | |
|---|---|---|---|
| 2,978,319 | 4/1961 | Chang | 148/125 |
| 3,413,166 | 11/1968 | Zackay et al. | 148/125 |
| 3,917,494 | 11/1975 | Kubotera et al. | 148/12 C |
| 4,083,220 | 4/1978 | Kobayashi et al. | 148/125 |
| 4,159,217 | 6/1979 | Selines et al. | 148/125 |

FOREIGN PATENT DOCUMENTS

| | | | |
|---|---|---|---|
| 1051307 | 12/1966 | United Kingdom | 148/125 |

OTHER PUBLICATIONS

Delisle et al. "Microstructural Studies of Tempered Extra-Low Carbon Steels and Their Effectiveness in Interpreting Tempered Martensite Brittleness", Metal Abstracts, Jan. 1975, 31-0119, p. 64.

Ripling "Tensile Properties of a Heat Treated Low Alloy Steel at Subzero Temperatures", ASM, Pub. No. 1, 1949, pp. 1-14.

"Carbon Steel Drawability Increased with Armco Cold Punch Process", Armco Steel Corp., Middletown, Ohio, pp. 1-5.

*Metals Handbook* Ninth Edition, vol. 1, "Properties & Selections : Irons & Steels," ASM, Metals Park, Ohio, 1978, p. 553.

Reed-Hill, *Physical Principles of Metallurgy,* Van Nostrand Reinhold Co., New York, 1964, p. 25.

*Primary Examiner*—Peter K. Skiff

*Attorney, Agent, or Firm*—Elizabeth F. Harasek

[57] ABSTRACT

A method is provided for improving the formability of low carbon steel sheet by heating it to a temperature above about 250° C. such that the interstitial element content of the steel's ferrite matrix is in the range of from about 5 to 50 parts by weight per million parts iron; quenching the steel to retain at least 5 weight parts per million parts iron of the interstitial elements in the ferrite; and cooling the steel to a temperature below about 0° C. for forming.

2 Claims, 12 Drawing Figures

METHOD OF TREATING LOW CARBON STEEL FOR IMPROVED FORMABILITY

This is a continuation, of application Ser. No. 71,651, filed Aug. 31, 1979 now abandoned.

This invention relates to a method of treating low carbon sheet steel prior to cold forming to significantly improve total elongation as measured in a tensile test. More particularly, the method relates to a method of increasing the formability of steel sheet by regulating the interstitial carbon content and lowering the forming temperature substantially below room temperature.

BACKGROUND OF THE INVENTION

Low carbon sheet steels find wide usage in the automotive industry due, at least in part, to their ability to be formed by stamping at relatively high production rates. Substantial material and weight savings can be accomplished if the total elongation, i.e., the amount that a steel sheet can be strained in a tensile test before fracture, is improved. A quantitative measure of the relative formability of different sheet steels is not readily determinable by laboratory tests. However, total elongation, as measured in a tensile test, does show correlation with formability. For example, if like gage steel sheet tensile specimen are tested, that exhibiting the greatest total elongation will have the greatest formability. Increased formability, evidenced by the ability to form deeper draws from like gage steel, allows greater latitude in part design. For example, it may obviate the need to form a part having a deep cross section in two pieces and later weld them together.

Before this invention, the formability of low carbon sheet steel was improved by raising the temperature of the sheet substantially above room temperature during forming. Another approach has been to vacuum de-gas sheet steel prior to forming to eliminate interstitial elements such as carbon, nitrogen, and oxygen and produce a substantially interstitial free steel. The absence of interstitial elements improves ductility. However, this process is relatively expensive, time consuming, and the interstitial free steel is not as strong.

OBJECTS OF THE INVENTION

It is therefore an object of this invention to provide a method of treating low carbon sheet steel, prior to cold forming, whereby its formability is improved. A more particular object is to provide a means of treating low carbon steel whereby the total elongation, as measured in a tensile test, is improved, particularly in the post-uniform elongation portion of the stress-strain curve. It is another object of the invention to combine the effects of heat treating, rapid quenching, and cooling sheet steel to a temperature below room temperature to improve its formability. A more particular object is to provide a method of heat treating low carbon steel to provide a desired interstitial element content in a ferrite matrix. A more particular object is to provide about 5 to 50 parts by weight interstitial carbon per one million parts iron by heat treating and quenching, and thereafter cooling the steel, as necessary, to a temperature below about 0° C. and forming at this lowered temperature.

Another object is to provide a method of treating "as received" sheet steel at the place it is formed to improve its ultimate elongation and formability. A further object of the method is to optimize interstitial element content and low forming temperatures of low carbon sheet steel to provide substantially improved total elongation and formability.

BRIEF SUMMARY OF THE INVENTION

In a preferred embodiment, these and other objects are accomplished as follows.

A sheet of desired gage low carbon steel (<0.5% by weight total carbon) is provided. A suitable steel would be, e.g., cold rolled aluminum killed 1008 steel sheet approximately 1.9 mm thick with an assay by weight of 0.05% carbon, 0.017% sulfur, 0.32% manganese, traces of common residual elements such as sulfur, and the balance iron. The steel is heated to a suitable temperature to cause a portion of the carbon, preferably 5 to 50 parts carbon per million parts iron, to migrate to interstitial positions in the body centered cubic ferrite matrix. Steel heat treated at a temperature of 390° C., e.g., will have an interstitial carbon content at equilibrium of 20 parts by weight per million parts iron. The steel is rapidly quenched to retain the carbon in interstitial solid solution in ferrite. The sample is then cooled to a temperature substantially below room temperature, preferably 0° C. or lower, and formed at that temperature. The total elongation of the above mentioned 1008 steel sheet is improved by a factor of 1.25 over the "as received" steel formed at room temperature when it is heat treated, as above, to develop an interstitial carbon content of 20 ppm and formed at a temperature of −73° C. at a strain rate of 0.0034 inverse seconds. Forming rates, interstitial element content, and temperature may be adjusted as taught herein to maximize total elongation and formability.

DETAILED DESCRIPTION OF THE INVENTION

A better understanding of the invention will be had from the following detailed description and examples. Reference will be made to the Figures in which.

Figure 1:
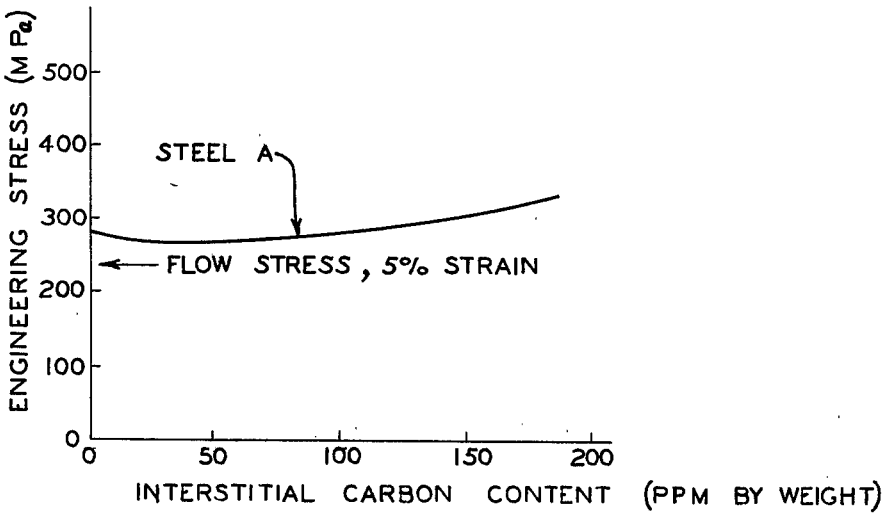
FIG. 1 is a plot showing experimental values for engineering stress for a steel sheet tensile sample subjected to flow stress at 5% strain versus interstitial carbon content.

Experiments were conducted with samples taken from two coils of aluminum killed (AK) 1008 steel. Steel from the 1.9 mm gage roll is designated "Steel A," and from 0.9 mm gage roll, "Steel B." The chemical assays of the major elements Steels A & B are given in Table I.

TABLE I

| Material Code | Gage (mm) | % C | % Mn | % S |
|---|---|---|---|---|
| Steel A | 1.9 | 0.05 | 0.32 | 0.016 |
| Steel B | 0.9 | 0.068 | 0.27 | 0.017 |

The subject invention may be used to treat all types of low carbon steel sheet or strip to improve formability. By low carbon steel herein is meant steel with a body centered cubic ferrite matrix and containing, by weights, no more than about 0.5% carbon and a total of no more than about 1.5% elements other than iron. Typical low carbon steel compositions range in weight percent from 0.05 to 0.15 carbon, 0.25 to 0.50 manganese, 0.035 maximum phosphorous, 0.04 maximum sulfur, traces of other elements, and the balance iron. Low carbon steels modified with small amounts of elements such as silicon, nitrogen, boron, titanium, vanadium, niobium, or copper, are also suitable. The steel sheet or strip may be either hot or cold rolled. Its quality designation, according to ASTM specifications, may be, e.g., commercial, drawing, drawing special, fully or partially killed, structural, or unspecified. Hot or cold rolled steel may be temper rolled or annealed prior to delivery, and the surface modified according to the end use.

To perform tensile tests described herein, standard rectangular tensile test specimens were cut to ASTM E-8 specifications from Steels A and B. The samples were approximately 8 inches long with a ¾ inch wide tab on either end. The test gage length was 2 inches and the width ½ inch. The test gage tapered inwardly from each of the tab ends. The tabs of the specimen were symmetrical with the center line of the reduced section within 0.01 inch.

Tensile properties of the samples were determined on an Instron tensile test machine at a constant strain rate of 0.0034 $s^{-1}$. Strain rate sensitivity tests were determined using the strain rate change method (see article entitled "Super-plasticity in an Al-Zn Alloy" in Transactions of the ASM, Volume 57, (1964) pp. 980–990) at strain rates of 0.0017 $s^{-1}$ and 0.017 $s^{-1}$. All tests were conducted at room temperature (about 20° C.) unless otherwise noted.

Carbon in low carbon steels as received from the mill is generally present as a microscopic cementite phase. A small percentage of the carbon will be present in solid solution as elemental carbon occupying interstitial positions in the iron atoms of the ferrite matrix. In accordance with a preferred practice of my invention, the steel sheet is first treated to provide an interstitial carbon content of 5 to 50 parts by weight per million parts iron. The carbon enters interstitial solution by the dissociation of iron or alloy carbides. The relative amounts of iron carbide and carbon at equilibrium is a function of temperature. Thus, a steel sheet is heated to, and maintained at, a suitable temperature for a time sufficient (generally about 2 hours) to reach the desired interstitial carbon content. The steel is then rapidly quenched so that the interstitial carbon is fixed in the ferrite and does not reform iron or alloy carbides during cooling. The interstitial carbon content of a rapidly quenched steel containing insignificant quantities of carbide forming alloying elements can be mathematically determined by the relationship $C=2\exp(-9100/RT)$ where C is the weight percent interstitial carbon, R is the universal gas constant (1.987 calorie/gram mole-deg. Kelvin), −9100 is the free energy of dissociation of iron carbide in calories/gram mole, and T is the temperature in degrees Kelvin. The calculated interstitial carbon content of several samples was experimentally verified by the Torsional Damping Method set forth in Diffusion in Solids by P. G. Shewmon, McGraw Hill, (1963) pages 87–94 and Elasticity and Anelasticity of Metals by C. Zener, University of Chicago Press (1948).

Samples of Steels A & B were heated to temperatures in the range of about 250° C. to 500° C. for times ranging about from 20 minutes to 180 hours to equilibriate the interstitial carbon content in the samples at from about 5 to 50 parts by weight per million parts iron. The samples were then immediately quenched in a 5% sodium hydroxide solution at room temperature. The heat treated and quenched steel should be formed soon after to avoid room temperature hardening brought about by the reformation of iron carbide from the interstitial carbon. Generally, steel can be retained at room temperature for about a week after heat treating without adverse effects on forming in accordance with the method.

The subject method depends in part on the presence of interstitial elements in a ferrite matrix. Thus the method is not applicable to steel without at least a few parts per million by weight of an interstitial element or elements. A typical value for carbon steels is in the range of 5 to 50 parts by weight interstitial carbon per million parts iron.

It has been hypothesized that the presence of an interstitial atom, such as carbon in the body centered cubic lattice of an alpha iron crystal strains the lattice more along one of the crystal directions than along the others. If a stress is applied to the crystal, deformation will occur by the motion of atoms dislocated in the crystal lattice (dislocations). The motion of the dislocations is believed to be impeded by the interstitial atoms and thus the iron is strengthened. However, it can be seen from FIG. 1 that the experimentally determined stress of Steel A shows only a relatively small increase in stress over a range of interstitial contents from a few parts by weight per million to 190 parts by weight per million. Thus, by itself, interstitial carbon content seems to have little actual effect on stress after moderate strain at room temperature.

Figure 2:
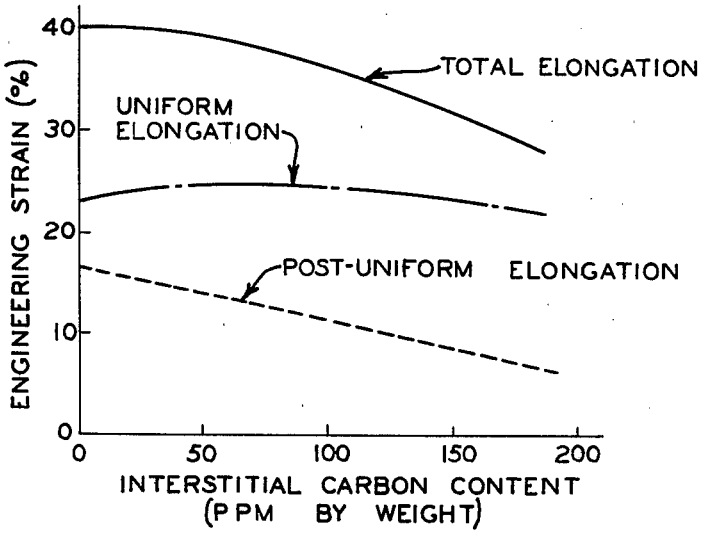
FIG. 2 is a plot showing engineering strain (strain rate 0.0034 $s^{-1}$) for total, uniform, and postuniform elongations of steel sheet samples versus interstitial carbon content tested at room temperature.

However, the elongation of a low carbon steel is affected by interstitial carbon content as seen at FIG. 2. Room temperature tensile testing of a standard 2 inch gage specimen of low carbon steel yields a characteristic curve of the type shown at FIG. 4. Where engineering stress is the ordinate, and engineering strain the abscissa, a hump shaped curve is produced. The portion of the curve between zero elongation and maximum stress (ultimate stress) describes uniform elongation of the sample. The portion of the curve between the maximum stress and the maximum elongation describes the post-uniform elongation of the sample. Unless otherwise indicated, the tensile tests were stopped just prior to fracture of the test specimen and the experimental curves terminated. The reported total elongation is the combination of uniform and post-uniform elongations. It can be seen from FIG. 2, that uniform elongation of a sample is relatively independent of interstitial carbon content between 0 and 190 ppm by weight at room temperature. However, the post-uniform elongation of a steel with a low interstitial carbon content is substantially higher than that of steel with a higher interstitial carbon content at room temperature.

The increase in strength observed to occur during elongation is due to two mechanisms: work (or strain) hardening and strain rate hardening. These hardening mechanisms both contribute to the total elongation of the sample: the work hardening contributing primarily to uniform elongation and the strain rate hardening primarily to post-uniform elongation as described in greater detail in Deformation Processing by W. A. Backoffen, Addison-Wesley (1972) pp. 199–220.

During post-uniform elongation, a neck forms in a tensile specimen. With continued stress, both the strain and the strain rate within the necked region of the sample are greater than in the un-necked regions. These strain effects, especially that brought about by strain rate hardening, tend to strengthen the material in the neck, offsetting the weakening due to the reduced cross-section and thickness, causing a shift of deformation to regions outside the neck. Strain rate sensitivity, m, may be mathematically defined as the change in the natural logarithm of the applied stress $\Delta \ln \sigma$, divided by the change in the natural logarithm of the true strain rate $\Delta \ln \epsilon$, that is, $m = \Delta \ln \sigma / \Delta \ln \epsilon$.

Figure 3:
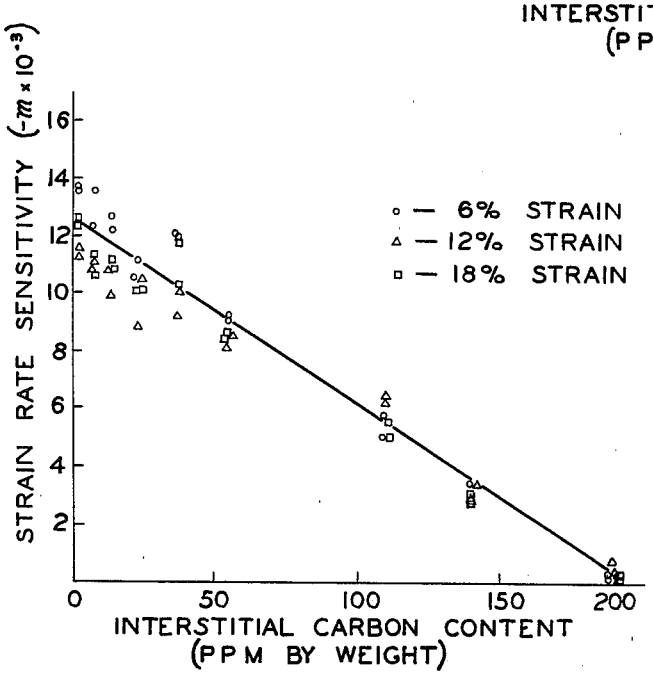
FIG. 3 is a plot of strain rate sensitivity as a function of interstitial carbon content for a steel sample tested at room temperature at strains of 6%, 12% and 18% based on a strain rate change of 0.0017 $s^{-1}$ to 0.017 $s^{-1}$.

FIG. 3 is a plot showing the experimental effect of interstitial carbon content on the strain rate sensitivity of Steel A. The strain rate sensitivity was measured at strains of 6%, 12% and 18%. The strain rate change was from 0.0017 $s^{-1}$ to 0.017 $s^{-1}$. The plot shows that the strain rate sensitivity is not dependent on the amount of strain in a sample. It also shows that strain rate sensitivity, and therefore strain rate hardening, is more pronounced for low interstitial carbon steel than for higher interstitial carbon steel, the maximum strain rate hardening being provided at interstitial carbon of contents between 1 and 5 ppm by weight.

Figure 4:
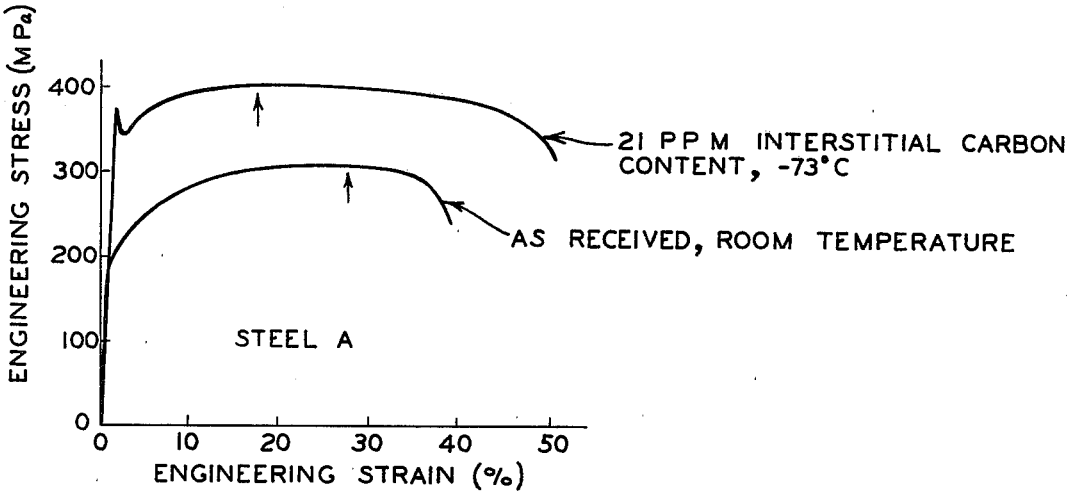
FIG. 4 is a stress-strain diagram generated in a tensile test showing the difference in the stress-strain characteristics between an "as received" steel sample tested at room temperature and a sample tested in accordance with the method of the invention.

FIG. 4 is a stress-strain diagram generated on an Instron tensile test machine with two standard ASTM E-8 steel specimens (2 inch test gage length) of Steel A. The one specimen was tested at room temperature in the "as received" condition. The second specimen was heat treated at about 390° C. and quenched to produce a 20 ppm interstitial carbon content and then submerged in a dry ice-methanol bath at −73° C. for testing. It can readily be seen from FIG. 4 that the total elongation of the heat treated and cooled sample was much greater than that of the sample tested at room temperature. The arrows on the curves show the approximate points of ultimate stress. The segment of the curve to the left of the arrow plots uniform elongation, while the segment to the right is the post-uniform elongation during which a neck forms and grows terminating in fracture. It is readily seen that adjusting the interstitial carbon content of Steel A to 21 ppm and reducing the temperature to −73° C. decreased the extent of uniform elongation in the sample relative to the "as received" sample. It also increased the stress at the yield point and yield point elongation. However, the post-uniform elongation portion of the curve is considerably extended, due to the advantageous effect of increased strain rate sensitivity. The total elongation of the sample treated in accordance with the invention was greater by a factor of 1.25 times that of the sample formed at room temperature in the "as received" condition.

Figure 5:
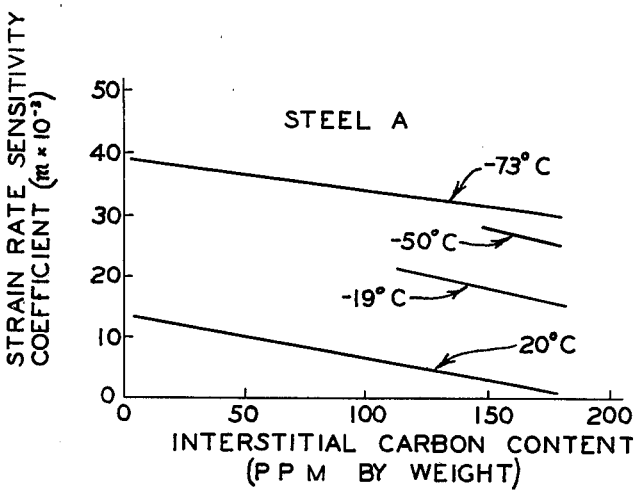
FIG. 5 is a plot showing the effect of interstitial carbon content on the strain rate sensitivity of an aluminum killed steel at temperatures of 20° C., −19° C., −50° C. and −73° C.

FIG. 5 is a graph showing the effect of interstitial carbon content on strain rate sensitivity for Steel A at temperatures of 20° C., −19° C., −50° C., and 73° C. Data were gathered on an Instron test machine at a tensile strain rate of 0.0034 $s^{-1}$. At this strain rate, the greatest strain rate sensitivity was recorded at −73° C. for all interstitial carbon contents between 4 and 190 parts per million by weight. The strain rate sensitivity at each temperature decreased linearly with increasing interstitial carbon content.

Figure 6:
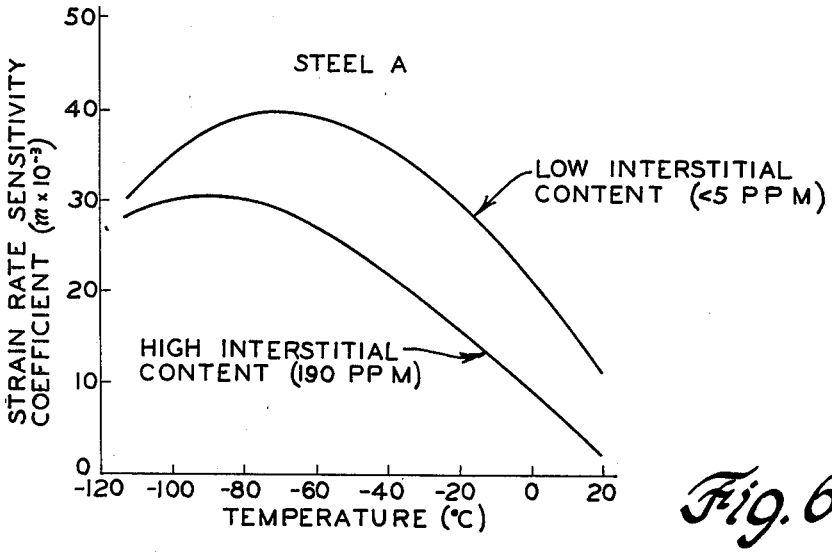
FIG. 6 is a plot showing the effect of temperature on the strain rate sensitivity of an aluminum killed steel at relatively high and low interstitial carbon contents.
Figure 7:
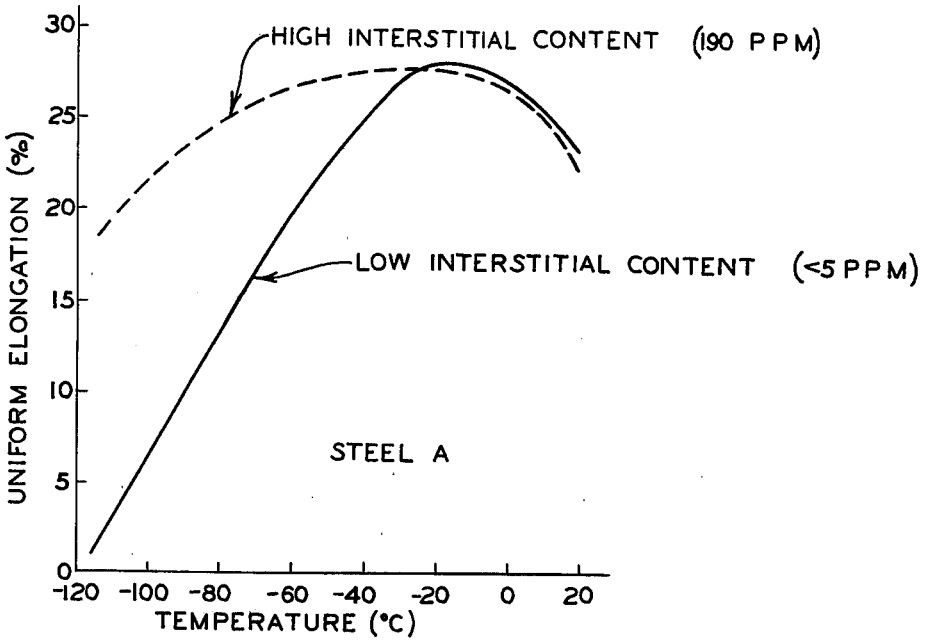
FIG. 7 is a plot showing the effect of temperature on the uniform elongation of an aluminum killed steel at relatively high and low interstitial carbon contents.

FIG. 6 shows the effect of decreased temperature on the strain rate sensitivity of Steel A at interstitial contents of less than 5 ppm and 190 ppm. The strain rate sensitivity of the low interstitial carbon sample was higher at the same temperature than the strain rate sensitivity of the higher interstitial content steel. FIG. 7, in contrast, is a plot of uniform elongation versus temperature for Steel A with interstitial carbon contents of 5 and 190 ppm. It is clear from FIG. 7 that a low interstitial carbon content decreases uniform elongation of the steel drastically at reduced temperatures. This negative effect on uniform elongation is not nearly as pronounced for the higher (190 ppm) interstitial carbon steel.

Figure 8:
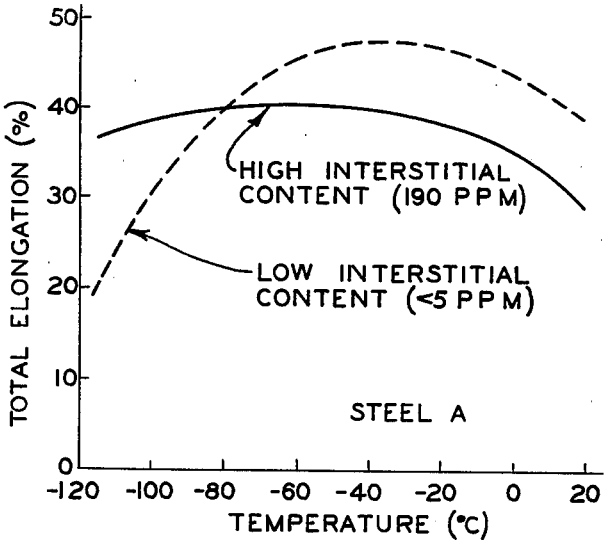
FIG. 8 is a plot showing the effect of temperature on total elongation of an aluminum killed steel sheet at relatively high and low interstitial carbon contents.
Figure 10:
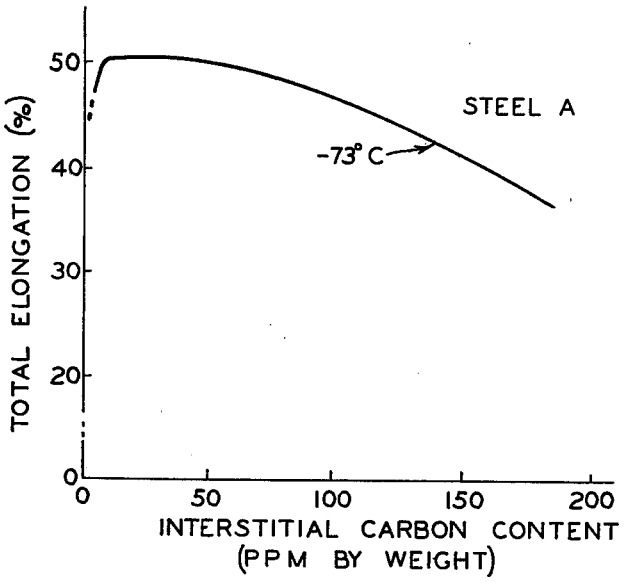
FIG. 10 is a plot showing total elongation versus interstitial carbon content for tensile specimen tested at −73° C.

Thus, one would expect that the increased elongation in the post-uniform elongation region of the stress strain curve provided by cooling and low interstitial carbon content would be cancelled or severely offset by the adverse effect on uniform elongation brought about by forming low interstitial carbon steel at low temperatures. That is, one would expect that the diametric effects of low carbon and low temperature in the uniform and post-uniform regions of the stress-strain curve would cancel each other out so that total elongation would not be improved. I have found that this is not the case, and that the combination of a relatively low interstitial carbon, in the range of 5 to 50 parts by weight carbon per million parts iron in low carbon steel, and cooling to a temperature substantially below room temperature, provides a synergistic improvement in total elongation of steel and improved formability. As seen from FIG. 10, the total elongation of Steel A drops off rapidly at interstitial carbon contents of 1 and 3 parts by weight per million parts iron, even at a lowered forming temperature of −73° C. FIG. 8 is a plot of the total elongation versus temperature for two samples of Steel A, one with an interstitial content of about 5 ppm and the other, 190 ppm. For the low interstitial carbon sample, the optimum forming temperature for maximum total elongation was about −35° C.

Figure 9:
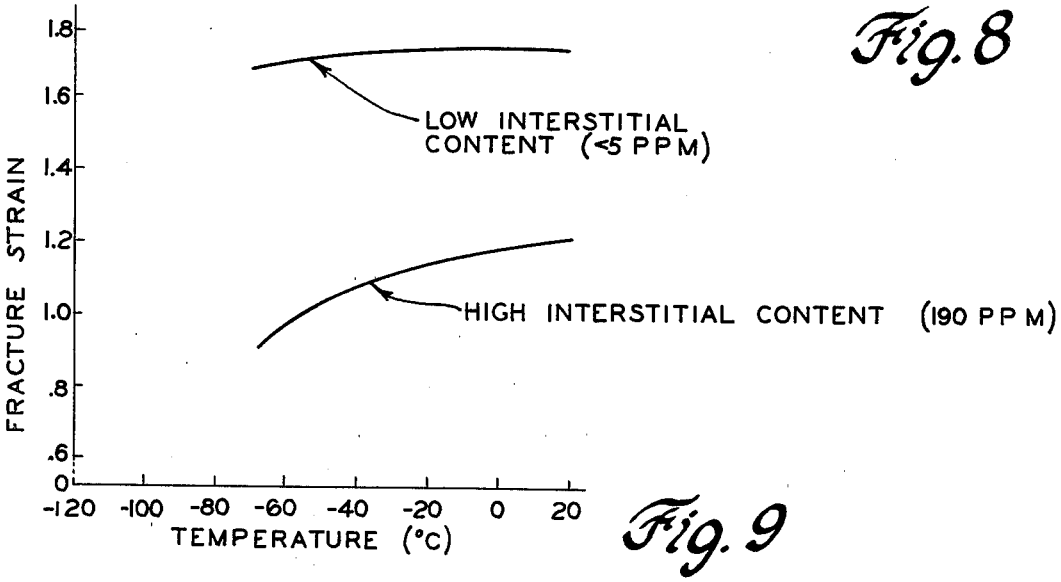
FIG. 9 is a plot showing the variations in fracture strain with temperature for an aluminum killed steel at relatively high and low interstitial carbon contents.

FIG. 9 is a plot of fracture strain versus temperature for about 5 ppm and 190 ppm interstitial carbon samples of Steel A. The fracture strain is the strain at which the tensile sample fails in the tensile test. The Figure shows that the sample with the low interstitial carbon content has a much higher fracture strain than steel with a high interstitial content over the entire temperature range of 20° C. to −73° C., while the fracture strain remains substantially constant at temperatures between −73° C. and 20° C. for the low interstitial carbon sample. The fracture strain in high interstitial carbon steel is actually decreased at reduced temperatures.

Figure 11:
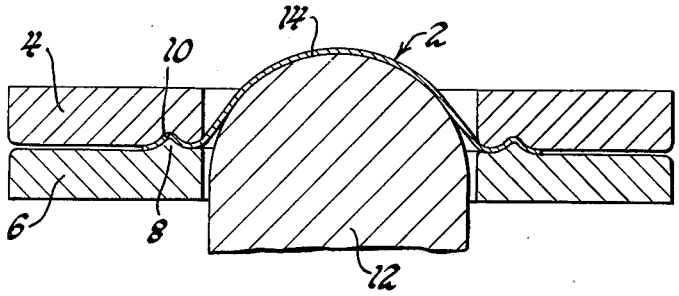
FIG. 11 is a sectional view of an apparatus for determining the limiting dome height of a metal sheet.

To confirm that the tensile elongation tests are indicative of improved formability of low carbon steel, limiting dome height tests were conducted. Limiting dome height is a preferred test for determining the formability of sheet steel because the strain state at failure can be precisely controlled by the test to duplicate the strain state at failure in an actual production stamping. The important features of the limiting dome height (LDH) apparatus, with a test specimen in place, are shown in FIG. 11. In the test, a square blank (160 mm×160 mm) of the sheet steel is photogridded with a pattern of 2.5 mm diameter circles. The blank 2 is firmly clamped between upper clamp portion 4 and lower clamp portion 6. The lower clamp portion is provided with a semicircular bead 8 having a radius of about 1.5 mm. The upper die is provided with a complementary recess 10 having a radius of about 3 mm to receive bead 8. When upper clamp 4 and lower clamp 6 are brought together, test sample 2 is crimped between bead 8 and recess 10 so that no flange drawing occurs during testing that could affect the dome height test results. Once the sample is in position, a cylindrical punch 12 with a hemispherical working surface 14 (50.8 mm radius) is pushed upwardly against sample 2 at a rate of 25 mm per minute. The limiting dome height measurement is taken at the maximum load on sample 2 before the development of a fracture. During the test, the circles of the gridded array become ellipses except in areas where pure biaxial stretching occurs. The major and minor axes of the ellipses are compared with the circles of the original grid to determine, respectively, the major and minor strains at each location. For tests conducted at temperatures below room temperature, a sheet of polyethylene was inserted between the test sample and the upper clamp portion and a wet bath of suitable temperature was contained in the well created thereby.

Figure 12:
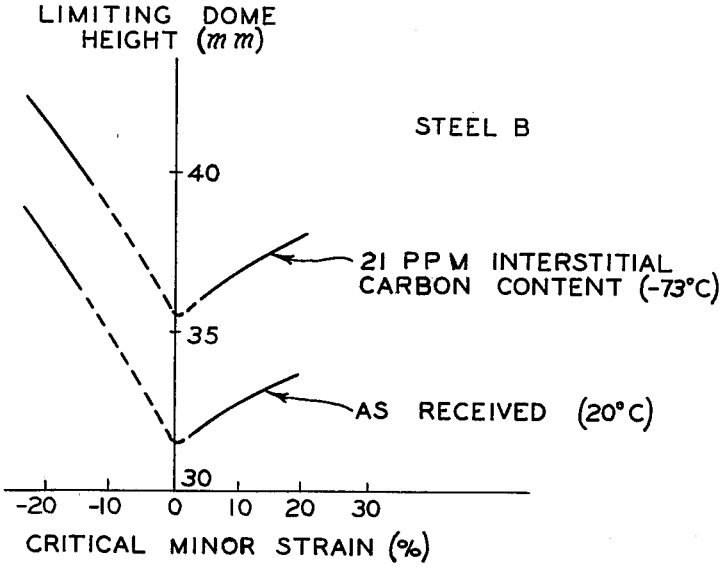
FIG. 12 is a plot showing the limiting dome heights of an aluminum killed low carbon steel in the "as received" condition and after treatment in accordance with the invention.

0.9 mm thick samples of Steel B were used to conduct the limiting dome height tests. FIG. 12 is a plot showing limiting dome height as the ordinate and critical minor strain in percent as the abscissa for Steel B "as received" formed at 20° C. (room temp.), and for Steel B heat treated to 21 ppm interstitial carbon formed at a temperature of −73° C. The minor strain at failure was varied by testing progressively narrower blanks that allow for progressively greater amounts of lateral drawn on the sample. It is readily seen from FIG. 11 that the limiting dome height, and thus the formability, of Steel B treated to have 21 ppm interstitial carbon content, and formed at −73° C., was much greater than the limiting dome height of the "as received" sample formed at room temperature.

The experiments described above pertain to the treating of an aluminum killed steel where carbon is the interstitial element. It will be appreciated that other interstitial elements such as oxygen, nitrogen, phosphorous or boron will provide the same effect. An aluminum killed steel was preferred for testing purposes because the killing process removes other interstitial elements, particularly oxygen and nitrogen, from the steel.

The above described tensile tests were performed at a strain rate of 0.0034 $s^{-1}$. I have postulated that for each tenfold increase in the strain rate, a 20° C. increase in the forming temperature would provide about the same improvement in total elongation at temperatures below about 0° C. For example, a certain improvement in an elongation would be provided by forming a low carbon steel sheet with a desired interstitial carbon content at −70° C. at a strain rate of 0.0034 $s^{-1}$. If that same sheet were formed at a strain rate of 3.4 $s^{-1}$ ($10^3 \times 0.0034\ s^{-1}$) then similar improved elongation would be provided at a forming temperature of [−73° C.+3(20)°C] or −13° C.

As seen at FIG. 8, a pronounced improvement in ultimate elongation before fracture is provided by forming low interstitial carbon steel at about −40° C. Taking into effect the faster forming rates of industrial stamping, similar improvements over "as received" steel can be accomplished by my method by first treating the steel at a suitable temperature and quenching to achieve a desired interstitial element content, preferably between 5 and 50 ppm, and then cooling the steel to a temperature below about 0° C. for forming.

In a manufacturing process, the method could be practiced as follows. A coil or precut blank of low carbon sheet steel would be heated in a furnace with an air or a slightly reducing atmosphere for about 2 hours. Thereafter, the steel would be immediately quenched in a liquid bath maintained at the desired forming temperature below room temperature. For example, the steel could be quenched in ethylene glycol or a caustic soda solution maintained at a temperature below about 0° C. with refrigeration coils. This method would be particularly adaptable to forming coiled sheet which could be drawn through the quench bath on suitable feed rollers, immediately sheared, and formed in cooled dies. It is important to the practice of the invention that the steel be at a temperature substantially below room temperature at the time it is formed.

While my invention has been described in terms of specific embodiments thereof, other forms could be readily adapted by one skilled in the art. Therefore my invention is limited only by the following claims.

The embodiments of the invention in which an exclusive property or privilege is claimed are defined as follows:

1. A method of forming steel sheet to provide deeper drawability before fracture, wherein said method the steel has a ferrite matrix and a carbon content less than about 0.5 weight percent, the method comprising heating said steel sheet at a temperature between about 250° C. and 500° C. for a time greater than about 20 minutes such that the interstitial carbon content of the ferrite matrix is equilibrated in the range of from about 5 to 50 parts by weight interstitial carbon per million parts iron;

immediately quenching said steel to retain about 5 to 50 parts per million parts iron of interstitial carbon in the ferrite matrix; and drawing said quenched steel at a temperature below about 0° C.;

the combination of controlling the interstitial carbon content of the steel in said range and forming the steel at said low temperature serving to substantially increase the total elongation of the steel before fracture as measured by limiting dome height and compared to the total elongation before fracture of like steel sheet formed at about 20° C. as received from the mill, the method having particular application to making articles which require substantial elongation of such steel without fracture.

2. A method of forming aluminum killed steel sheet to provide deeper drawability before fracture, wherein said method the steel has a ferrite matrix and a carbon content less than about 0.5 weight percent, the method comprising heating said steel sheet at a temperature between about 250° C. and 500° C. for a time greater than about 20 minutes such that the interstitial carbon content of the ferrite matrix is equilibrated in the range of from about 5 to 50 parts by weight interstitial carbon per million parts iron;

immediately quenching said steel to retain about 5 to 50 parts per million parts iron of interstitial carbon in the ferrite matrix; and drawing said quenched steel at a temperature below about 0° C.;

the combination of controlling the interstitial carbon content of the steel in said range and forming the steel at said low temperature serving the total elongation of the steel before fracture as measured by limiting dome height by at least about 25 percent compared to the total elongation before fracture of like aluminum killed steel sheet formed at about 20° C. as received from the mill, the method having particular application to making deeply drawn articles which require substantial elongation of such steel without fracture.

* * * * *